US005179847A

United States Patent [19]

Dorn

[11] Patent Number: 5,179,847

[45] Date of Patent: Jan. 19, 1993

[54] SKATEBOARD SECURITY DEVICE

[76] Inventor: Bryan B. Dorn, 1400 E. Central Ave., Fullerton, Calif. 92631

[21] Appl. No.: 906,061

[22] Filed: Jun. 29, 1992

[51] Int. Cl.[5] ..... E05B 73/00

[52] U.S. Cl. ..... 70/18; 280/87.042; 280/809; 70/58; 70/57

[58] Field of Search ..... 70/14, 18, 30, 49, 58, 70/57, 225, 226, 233; 280/87.042, 825, 809

[56] References Cited

U.S. PATENT DOCUMENTS

| | | | |
|---|---|---|---|
| 4,057,983 | 11/1977 | Morgan | 70/58 |
| 4,126,024 | 11/1978 | Timmons et al. | 70/233 |
| 4,313,610 | 2/1982 | Volk et al. | 280/87.042 |
| 4,364,187 | 12/1982 | Melendez | 280/825 |
| 4,372,138 | 2/1983 | Mickelson | 70/14 |
| 4,382,615 | 5/1983 | Gronborg et al. | 280/825 |
| 4,404,822 | 9/1983 | Green | 70/233 |
| 4,680,949 | 7/1987 | Stewart | 70/58 |
| 4,773,239 | 9/1988 | Lowe et al. | 70/38 A |
| 4,878,045 | 10/1989 | Tanaka et al. | 340/556 |
| 4,970,882 | 11/1990 | Arrendondo | 70/30 |
| 4,971,345 | 11/1990 | Braun et al. | 280/288.4 |
| 5,040,385 | 8/1991 | Randone | 70/62 |

*Primary Examiner*—Renee S. Luebke
*Assistant Examiner*—D. Boucher
*Attorney, Agent, or Firm*—Robert T. Spaulding

[57] ABSTRACT

A cable locking device consisting of two axially slotted cylindrically shaped closed-end structures, each having attached a rigid tube of smaller diameter than the cylinder. The length of each tube is greater than half the wheelbase of a skateboard, and one tube will fit within the other. The axial slots allow each cylinder to be guided over the trucks of a skateboard, entirely encompassing the truck and associated mounting hardware. Upon installation of the device, the smaller rigid tube has been incorporated within the larger tube. The free end of an attached locking cable is inserted into two aligned apertures, one on each tube, and a locking device contained within the larger tube secures the cable in place.

5 Claims, 1 Drawing Sheet

SKATEBOARD SECURITY DEVICE

BACKGROUND OF THE INVENTION

1) Field of the Invention

This invention relates generally to a cable locking device and more specifically to a cable locking device that additionally provides security for the individual components of the skateboard to which it is attached.

2) Description of the Prior Art

Cable locking devices for bicycles and motorcycles are well known in the art, for example, U.S. Pat. No. 4,126,024, U.S. Pat. No. 4,404,822, U.S. Pat. No. 4,878,045, U.S. Pat. No. 4,970,882, and U.S. Pat. No. 4,971,345. When the cables incorporated in these devices is looped through the frame or wheel of a bicycle or motorcycle and then around a fixed structure, that portion of the vehicle incorporated within the loop is secure. However, portions of the vehicle not incorporated within the loop are vulnerable to theft.

Accordingly, one object and advantage of this invention is to provide a cable locking device for skateboards.

Another object and advantage of this invention is to provide security for each and every component of the vehicle to which it is attached.

Another object and advantage of this invention is that no modification to the skateboard is required in order to use the device.

Further objects and advantages of this invention will become apparent from consideration of the drawings and ensuing description of it.

SUMMARY OF THE INVENTION

The present invention comprises two axially slotted cylindrically shaped closed-end body structures, henceforth called cylinders, each of sufficient diameter to encompass one of the two trucks of a skateboard. A rigid tube is attached at right angles at the midpoint of each cylinder. The length of each tube is greater than half but less than the wheelbase of the skateboard. The diameters of the tubes are less than the diameter of the host cylinder, and are dimensioned such that one tube will fit within the other. A length of cable of sufficient length to loop around a fixed structure is affixed to the smaller tube. Located near the unattached end of the smaller tube, at right angles to the axis of the tube, is an aperture of sufficient size to accomodate the free end of the cable and an aperture to accomodate the cable locking device. An aperture of sufficient size to accomodate the free end of the cable is also located near the unattached end of the larger tube, at right angles to the axis of the tube, along with the cable locking mechanism.

To use the security device, the skateboard to be secured is placed upside down and a cylinder is located between a truck and the end of the skateboard with the rigid tubes in coaxial alignment with the skateboard and facing the center of the skateboard. The smaller tube is then inserted within the larger tube. The two cylinders are then coaxially guided toward the center of the skateboard until the aperture of the smaller tube is in conjunction with the aperture of the larger tube. The free end of the cable is then looped around a fixed structure and inserted into the aligned apertures. The cable is then locked in place.

During the installation procedure, the axial slots in the two cylinders have accomodated the truck wheels and truck mounting hardware, fully enclosing the trucks within the cylinders. Hence each and every component of the skateboard and the skateboard itself is rendered secure.

DESCRIPTION OF THE PREFERRED EMBODIMENT

Figure 1:
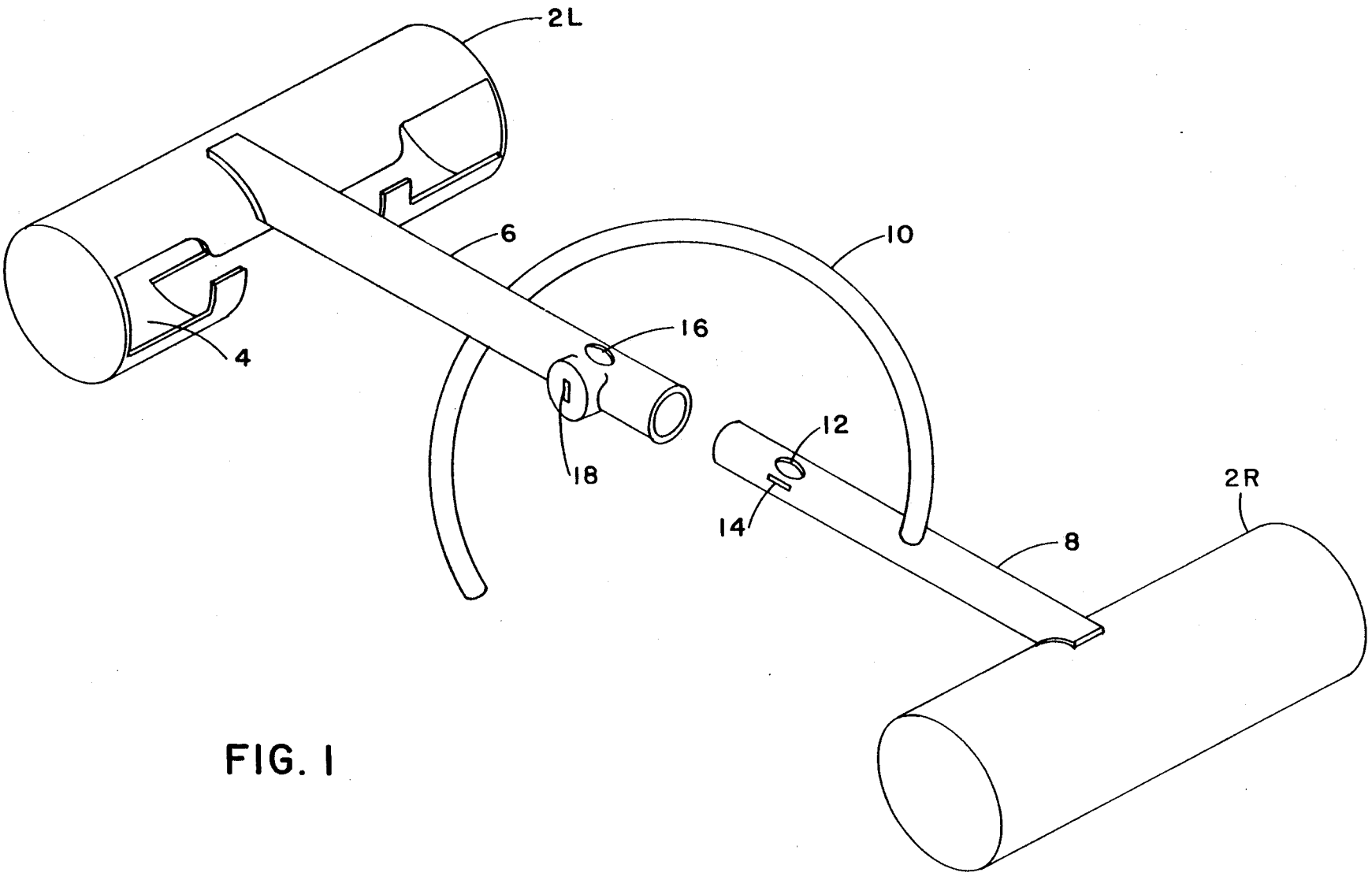

FIG. 1 shows the two structures which comprise the invention in conjunction, preparatory to installation.

The two cylinders 2L and 2R are displayed such that the axial slots 4 which accomodate the skateboard truck are shown on cylinder 2L. These slots are symmetrically located about the larger rigid tube 6. In like manner, cylinder 2R is slotted with symmetry about the smaller tube 8. This symmetry allows the cylinders to be placed on the skateboard at random. Upon installation of the two cylinders, the free end of the locking cable 10 is looped around a suitable structure and into the aligned apertures 12 and 16. The cable is rendered secure by locking device 18.

Based on the description of FIG. 1 it can be seen that both skateboard trucks are rendered secure within the containing cylinders which in turn are secured by the cable locking arrangement.

Although the description above contains many specifications, these should not be construed as limiting the scope of the invention, but as merely providing illustrations of some of the presently preferred embodiments of this invention. Thus the scope of the invention should be determined by the appended claims and their legal equivalents, rather than by the examples given.

What is claimed is:

1. A skateboard security device comprising a pair of axially slotted cylindrically shaped closed-end body structures of sufficient diameter to encompass a truck of said a skateboard, each body structure having a single rigid tube, dimensioned such that one tube will fit within the other, attached normal to the midpoint of the body structure; each rigid tube having an aperture of sufficient diameter to allow the insertion of the free end of a locking cable when the two rigid tubes are in conjunction and the apertures are in alignment; the rigid tube of lesser diameter having attached a locking cable of sufficient length to loop around a fixed structure, and the rigid tube of greater diameter having locking means adjacent to the corresponding aperture.

2. The security device of claim 1 wherein the axial slots are dimensioned to conform to contours of said skateboard truck.

3. The security device of claim 1 wherein each rigid tube has a length greater than half but less than the distance between the skateboard trucks.

4. The security device of claim 1 wherein each aperture is located at the unattached end of the respective rigid tube.

5. An apparatus for providing security to a skateboard and its components comprising:

a) a pair of axially slotted cylindrically shaped closed-end body structures of sufficient diameter such That each will enclose one of the truck and its associated mounting hardware;

b) a pair of rigid tubes of unequal diameter, one member of the pair attached to the midpoint of each of the body structures, the length of each tube being greater than half but less than the entire wheelbase of the skateboard; each rigid tube having at the unattached end an aperture of sufficient diameter to accomodate the free end of a locking cable, the rigid tube of smaller diameter having attached a locking cable of sufficient length to loop around a fixed structure, the rigid tube of greater diameter having locking means for securing the free end of the locking cable.

* * * * *